US008115641B1

(12) United States Patent
Dempsey

(10) Patent No.: US 8,115,641 B1
(45) Date of Patent: Feb. 14, 2012

(54) AUTOMATIC FALL DETECTION SYSTEM

(76) Inventor: Michael K. Dempsey, Groton, MA (US)

( * ) Notice: Subject to any disclaimer, the term of this patent is extended or adjusted under 35 U.S.C. 154(b) by 370 days.

(21) Appl. No.: 12/426,073

(22) Filed: Apr. 17, 2009

Related U.S. Application Data

(60) Provisional application No. 61/124,712, filed on Apr. 18, 2008.

(51) Int. Cl.
*G08B 23/00* (2006.01)

(52) U.S. Cl. ..... 340/573.1; 340/573.4; 340/573.7; 340/522; 600/595

(58) Field of Classification Search ..... 340/573.1, 340/573.3, 573.4, 573.5, 573.7, 522, 529, 340/540, 541; 600/595, 587; 395/838; 345/83
See application file for complete search history.

(56) References Cited

U.S. PATENT DOCUMENTS

| | | | | |
|---|---|---|---|---|
| 5,905,436 | A * | 5/1999 | Dwight et al. | 340/573.1 |
| 6,211,787 | B1 * | 4/2001 | Yoshiike et al. | 340/573.1 |
| 2007/0063850 | A1 * | 3/2007 | Devaul et al. | 340/573.1 |

* cited by examiner

*Primary Examiner* — Anh V La
(74) *Attorney, Agent, or Firm* — Nelson Mullins Riley & Scarborough LLP; Anthony A. Laurentano

(57) ABSTRACT

A system and a method for detecting if a person has fallen down is provided. The system includes at least two sensors which remotely detect energy in at least two zones. The output of the sensors are analyzed and compared to characteristics which are determined to be representative of a fall. If the sensor outputs match the particular characteristics, the system concludes that a fall has occurred and outputs this result. An alarm may be generated if the system detects a fall.

11 Claims, 16 Drawing Sheets

AUTOMATIC FALL DETECTION SYSTEM

REFERENCE TO RELATED APPLICATIONS

This application claims the benefit of provisional patent application U.S. Ser. No. 61/124,712, filed Apr. 18, 2008, the contents of which are hereby incorporated by reference.

FIELD OF THE INVENTION

The present invention relates to the detection of falls by humans, in particular elderly people. More specifically, the present invention relates generally to a remote sensor that can determine if a person has fallen down by analyzing signals received by the sensor in at least two zones.

BACKGROUND OF THE INVENTION

Falls among the elderly are at epidemic proportions worldwide. Approximately one out of every three seniors fall in any given year, and these falls are the most common cause of injury and hospital admissions among this group. In 2003, the last year data available from the U.S. Centers for Disease Control and Prevention (CDC), 1.8 million U.S. elders were treated in emergency departments for nonfatal injuries related to falls and 13,700 died of fall-related injuries. By 2020, the CDC estimates that the annual cost of falls among the elderly will be $43.8B. Furthermore, it has been shown that the longer seniors have to wait for help to arrive after they have fallen, the higher the chances are that they will die, have to be admitted to the hospital, or end up in a nursing home. Therefore, it is critical to get help to people as quickly as possible if they fall.

Falls are not only an issue for the elderly living in their own homes. People in acute-care, rehabilitation and psychiatric hospitals, skilled nursing facilities, independent and assisted living facilities also are vulnerable to falls. These institutions are also susceptible to liability risks when their patients or residents fall.

The magnitude of the problem of falls among the elderly has been apparent for many years, and hence there have been many prior art attempts to create fall prevention or detection systems that address this concern.

The simplest and most common solution to the detection of falls among the elderly is not a true detection system, but rather simply employs a "panic button". Systems of this type are often called Personal Emergency Response Systems (PERS), and are provided by companies such as Philips Life-Line, Framingham, Mass. If a person has fallen or otherwise needs help, they push a button on a transmitter that is worn around their neck or on their wrist. This transmitter sends a radio signal to a receiver/speaker-telephone, which is plugged into the telephone line. The reception of the radio signal causes the receiver/speaker-telephone to call a preprogrammed telephone number of a response center, where the phone is answered by an operator. The operator can then use the speaker-telephone to ask the victim if they need help. The obvious and significant limitations of this approach include: (i) the need for the elderly person to push the button, which may be difficult if the person is unconscious or has dementia so forgets the button; (ii) the elderly person must always have the button within reach (even at night); (iii) the button/transmitter must be within radio range of the receiver/speaker-phone; and (iv) many elderly people do not enjoy wearing the button.

Other conventional systems also have significant drawbacks. For example, another prior art system employs a loadsensor that is integrated into a bed or chair, or can be implemented by placing a pad, sheet-liner or other similar device on the bed, chair or floor next to the bed to detect if a patient has moved off the bed or chair. Products representative of this approach are sold under the tradename NoFalls® by Hill-Rom (Batesville, Ind.), alarms and pads from AliMed (Dedham, Mass.), and the Tabs System® from Stanley Senior Technologies (Lincoln, Nebr.).

U.S. patent application publication no. 2008/272918A1 describes how sensors of this type can be configured as a system. However, all of these systems are limiting in that the potential fall victim must normally be in the bed or chair and their exit from the bed must represent an unusual circumstance. These solutions only work for patients who spend essentially all of their time in bed. Even for the sickest elderly patient who is still in their home, or patients who simply wish to get out of bed to use the bathroom, these solutions are impractical.

U.S. Pat. No. 5,490,046 describes another even more limiting "bed exit alarm" type system where a short string is connected between an alarm and the patient—when the patient leaves the bed, the string is pulled out of the device which in turn activates an alarm. U.S. Pat. Nos. 5,471,198, 6,204,767, 6,211,787 and 6,788,206 describe variations on this theme where a sensor measures the distance a patient is from the head of the bed or the back of the chair and alarms if that distance changes. Again, these prior art systems require the potential victim to be normally confined to a bed or chair.

Another prior art approach is to have a potential fall victim wear an accelerometer. This accelerometer is tuned such that if the person wearing the device falls down, the accelerometer detects the force of impact and sends a radio signal to a similar receiver/speaker-phone as described above. There are many variations on this theme in the art. An example of this type includes PCT Publication Number WO 2006/038941A2 which describes a fall-sensor accelerometer that is integrated into a mobile phone. A commercial product based on the accelerometer approach is offered by Tunstall (Yorkshire, UK). Systems of this type primarily attempt to overcome historically significant limitations such as false alarms generated when the patient sits or lays down abruptly. However, none of the prior art overcomes the fundamental flaw in the approach that the potential fall victim must wear the device on their person constantly—even at night. Other limitations include (i) the relatively high rate of false alarms generated from normal activities of daily living (ADL) or having the sensing accelerometer accidentally drop to the floor; (ii) the relatively high cost of such a device; (iii) like the PERS above, the sensing device must be within radio range of the receiver/speaker-phone; and, similar to the PERS, (iv) many elderly patients do not enjoy wearing the accelerometer.

Another prior art solution is the whole-house monitoring systems or "Smart Homes." Prior art systems of this type have the potential to indirectly address the problem of fall detection by determining if the elder's normal ADL habits are compromised. These systems rely on sensors placed throughout the elder's home which communicate to a computer that infers ADL activities. For example, if a motion sensor in the bedroom normally senses movement at approximately 7:00 AM every morning, then one day if there has been no motion sensed by 8:00 AM, the system may infer that something is wrong and call for help. Systems such as described in U.S. Pat. Nos. 4,259,548, 6,445,298, 6,696,957, 6,825,761, 7,242,305 and 7,405,653. An example of prior art systems of this type is disclosed and described in U.S. patent application publication no. 2008/0186189A1 which employs an algorithmic approach to gathering data and inferring ADL levels from the data. However, none of these systems directly detects falls, but rather infer that a fall or other emergency has occurred because the dweller's normal patterns have changed. These systems are severely limited because (i) they only work with a single person living in the home; (ii) they require complex and expensive computer and sensor infrastructures to be installed throughout the entire home; and (iii) most significantly, they typically take many tens-of-minutes to hours before they determine that a pattern is truly changed and hence an alarm should be generated—these are many hours that a fall victim is potentially lying in pain on the floor.

Yet another prior art approach is to sense vibrations in the floor to determine if something large has unexpectedly hit the floor. Two published U.S. patent applications that describe this approach are 2006/0195050A1 and 2007/0112287A1. While this approach has the advantage of not requiring the user to wear anything, it appears to be of limited practicality. Practically deploying a system such as this is difficult because the system needs to be "tuned" to different flooring materials (cement, wood, carpeting, etc.) and building constructions (apartment vs. single home, first-floor vs. second-floor, etc.) Fundamentally, such an approach is limited because it will never be able to distinguish the vibrations generated from a 90 lb elderly women falling to the floor from those of a 90 lb dog jumping off the couch.

More direct monitoring approaches have also been tried. Indeed, a video monitoring system has also been suggested to detect falls, as set forth for example in U.S. Pat. Nos. 6,049,281 and 7,110,569, and in U.S. patent application publication no. 2003/0058111A1. While this approach again has the advantage of allowing remote detection of falls, it has a very significant limitation in that it requires video cameras to be constantly monitoring all the rooms of the elder's home. This creates obvious and significant privacy concerns.

Finally, there are also a variety of approaches which are based on conventional motion detectors used in security systems. While not a fall sensor, U.S. Pat. No. 5,023,593 describes a swimming pool alarm which senses motion in a thin zone just above the water. U.S. Pat. No. 6,462,663 teaches that complex lensing can be used with motion sensors to create many smaller zones, essentially creating a grid in a room, to be used for location and tracking. U.S. Pat. No. 5,905,436 describes a fall sensor which uses two conventional security system motion detectors which effectively divide a room into two horizontal sections, for example, a top half and a bottom half. If the system initially detects motion in both the top and bottom halves, then subsequently only in the bottom half, it concludes that there is a fall. This system has an advantage over the aforementioned solutions in that it does not require the person to wear a device or take any deliberate action (other than falling) to generate an alarm. However, there are several serious limitations with this approach which makes its use by an elderly patient impractical. First, solutions that use conventional motion detectors are extremely prone to false alarms generated by pets, children or even changes in heat. Second, the approach is flawed if the person falls and becomes unconscious, since the algorithm cannot distinguish an unconscious fall victim from no motion in the room. In this circumstance, no alarm sounds. Third, motion detectors are optimized for security use and hence are optimized for side-to-side (i.e. walking) movement. Consequently, the up-and-down movement of a fall is harder for systems of this type to detect which can lead to missed events. Finally, systems of this type require custom installation, mounting of motion detectors near the ceiling and "tuning" of the motion detectors' reception pattern for each room of the home, and hence are expensive and difficult to install.

SUMMARY OF THE INVENTION

Therefore, there is a need in the art for a system that can automatically and remotely detect if someone has fallen. This helps elders live longer and more safely in their own homes. Such a system helps patients and residents of institutions receive care quickly in the event of a fall. The system also increases safety and reduces the aforementioned costs by automatically detecting if someone has fallen and then immediately summoning help.

The system of the present invention is simple enough to be installed and used by the elder, does not require special networking infrastructure (including an Internet connection), and does not require the elder to wear a special device, push any buttons if they fall or change their lifestyle in any way. The system is also highly immune to false alarms caused by pets, crawling children, laying down in bed or the elder purposely getting down on the floor. Finally, the system is inexpensive enough to be available to virtually anyone of any economic means.

The system of the present invention may include a first sensor, a second sensor, a processor and a transmitting device. These sensors may be active or passive. A passive sensor is one that measures or senses a property of the measured entity directly such as a passive infrared (PIR) sensor which measures infrared radiation emitted or an accelerometer which measures vibrations. An active sensor is one that measures changes caused by the entity being measured to a signal which the sensor generates—examples of this include ultra-wideband sensors, radar or active infrared sensors. The first sensor and the second sensor may sense signals associated with the detected energy generated by the human to a processor. The signal may be sent directly to the processor. Alternatively, the signal may be sent to an analog-to-digital converter that converts the analog data from the sensors to a digital data and sends the digital data to the processor. The processor may include a pattern recognition logic that matches the data associated with the first sensor and the second sensor with a predetermined pattern. The predetermined pattern may be associated with a human activity, such as getting off the bed, or with a human fall. When the pattern recognition logic determines a match, the processor generates an output, e.g. a signal. The processor may send the output to a transmitting device via a wired or wireless connection. The processor or the transmitting device may contact an entity, e.g. a response center, or may sound an alarm.

The method of the present invention includes receiving data associated with a first sensor and a second sensor using a processor. The first sensor and the second sensor may sense or detect energy generated by a human. The data associated with the first and second sensors may be related to the detected energy generated by the human. The processor may then analyze the data associated with the first and second sensors. The analysis may include comparing a pattern formed by the data associated with the first and second sensors with a predetermined pattern. The predetermined pattern may be associated with a human activity, such as getting off the bed, or with a human fall. When there is a match between the pattern formed by data associated with the first and second sensors and the predetermined pattern, the processor may generate an output indicative of the match. The output generated by the processor may be different for each predetermined pattern.

BRIEF DESCRIPTION OF DRAWINGS

These and other characteristics of the automatic fall detection system will be more fully understood by reference to the following detailed description in conjunction with the attached drawings, in which.

DETAILED DESCRIPTION OF THE INVENTION

Figure 1:
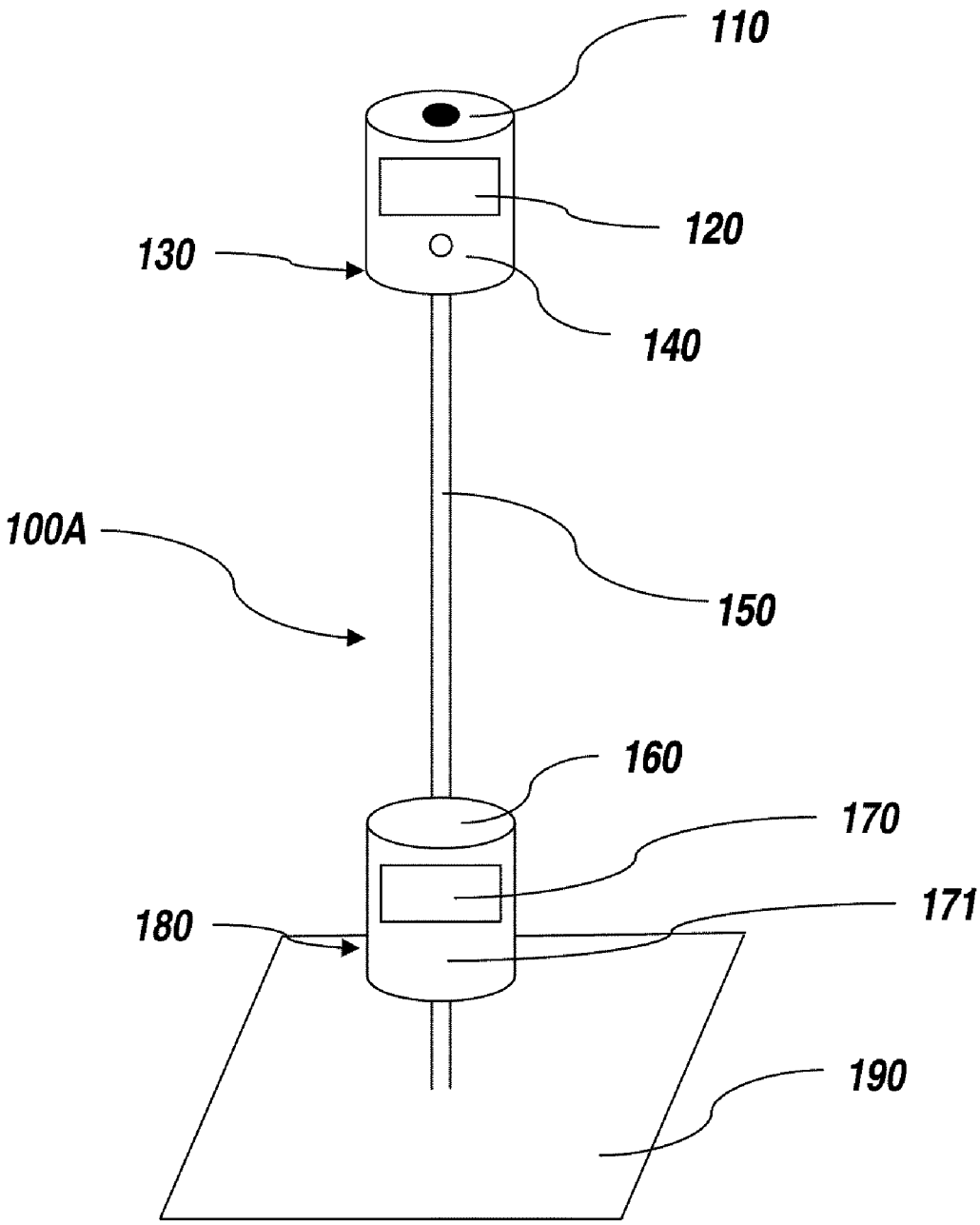
FIG. 1 is a perspective view of the a free-standing embodiment of the fall detection system according to the present invention.

The present invention provides a system that can detect if a person has fallen down. FIG. 1 depicts an exemplary embodiment of such a fall detection system 100A according to the teachings of the present invention. The illustrated system 100A includes a top sensor assembly 130 and a bottom sensor assembly 180. The top and bottom sensor assemblies 130 and 180, respectively, are mounted by known techniques on a pole 150 or other similar support mechanism. The top sensor assembly 130 has a sensor or detector 120 in the top assembly which senses thermal or other type of energy. Likewise, the bottom sensor assembly 180 has a sensor 170 which also senses or detects thermal or other type of energy.

The fall detection system 100A also includes one or more buttons 110 and one or more visual indicators or annunciators or both, such as an LED 140 or other suitable indicators. Either assembly may also include a broadcast module 160 (e.g., a radio transmitter) and/or an annunciator 171. The pole 150 can be affixed to a base 190 using known techniques to allow the fall detection system 100A to remain in an upright position. The illustrated embodiment is appropriate for an easy to install free-standing deployment such as one may find in a residential home or other suitable site.

Figure 2:
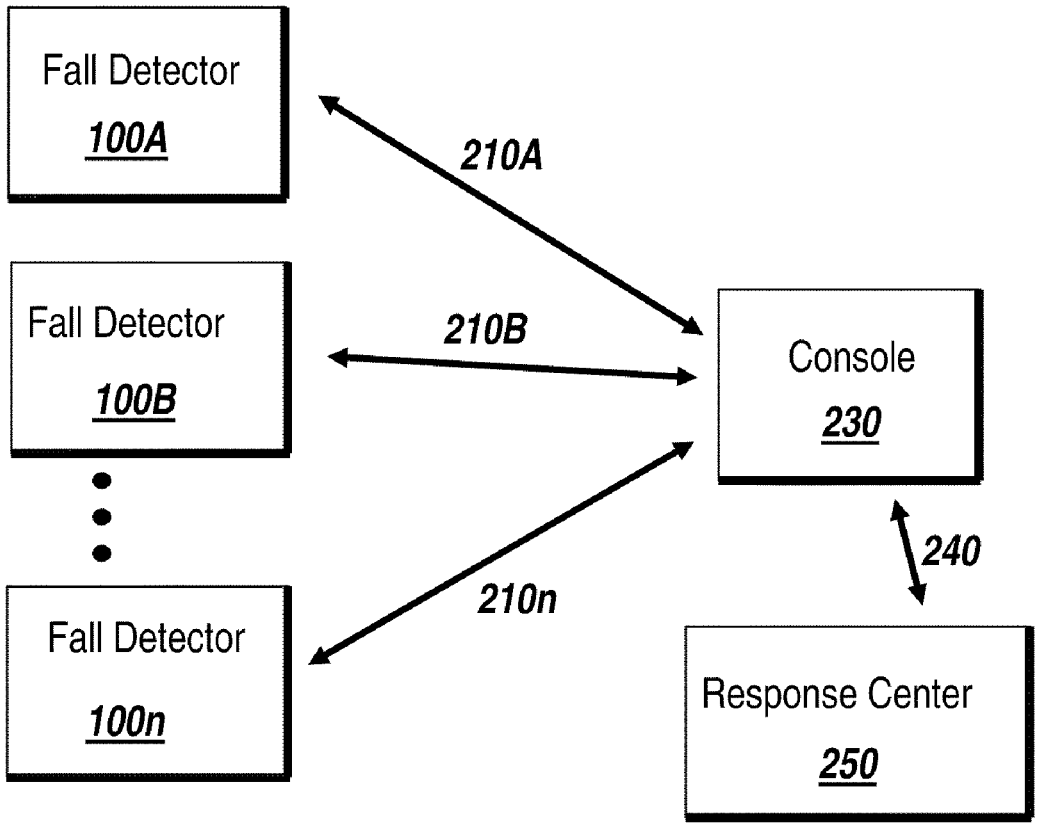
FIG. 2 is a schematic block diagram illustrating the network capability of the fall detection system of the present invention, including the use of multiple fall detection systems with an optional console which can communicate with an optional response center.

When the fall detection system 100A detects that a person has fallen it may convey an alarm through the indicator 140 and/or annunciator 171. The system 100A may also send a message or alert signal to another local or remote system. FIG. 2 depicts one exemplary configuration of an overall detection system which consists of one or more fall detector systems 100A, 100B through 100*n* that is coupled or in communication with an optional console 230, which in turn can communicate with a response center 250. Alternatively, the fall detector systems 100A, 100B through 100*n* can communicate directly with the response center. Multiple detectors may be required to provide protection in multiple physical locations (e.g., different rooms of an elderly complex or home). Upon detection of a fall, any of fall detection systems can optionally send an alarm signal or message through a wired or wireless link 210A, 201B through 201*n* to the console 230, response center 250, and/or other suitable location. For purposes of simplicity and by way of example, and not to be construed in a limiting manner, the one or more of the illustrated fall detector systems 100A, 100B through 100*n* may employ a broadcast module as set forth above to transmit a signal to the console of a Personal Emergency Response System (PERS), such as those provided by Philips LifeLine (Framingham, Mass.). The PERS console (e.g., console 230) then can establish a communication link 240 to the emergency response center 250 through any suitable network or system, such as through a public switched telephone network (PSTN), a cellular telephone, the Internet or any other type of suitable communication network. The fall detector systems 100A, 100B through 100*n* may also communicate directly with a response center or other designated person or entity through any appropriate one-way or two-way, wired or wireless link, for example a cellular, PSTN, Internet or other suitable communication link 240. The fall detector systems 100A, 100B through 100*n* may also communicate with each other through the use of a wireless LAN, a mesh-network (such as ZWave® or Zigbee®), or other appropriate wireless link. Similarly the detector assemblies may communicate with each other or the consoles through a variety of wired links such as Ethernet, RS-485, Nurse Call Wiring, Universal Serial Bus (USB), etc. Those skilled in the art will readily appreciate that any type of wired or wireless links, networks or systems may be used to allow the fall detector systems of the invention to communicate with each other or other systems or components, such as those described above. Since these types of systems are well known, we deem it unnecessary to provide the specifics of the communications mechanisms herein.

Figure 3:
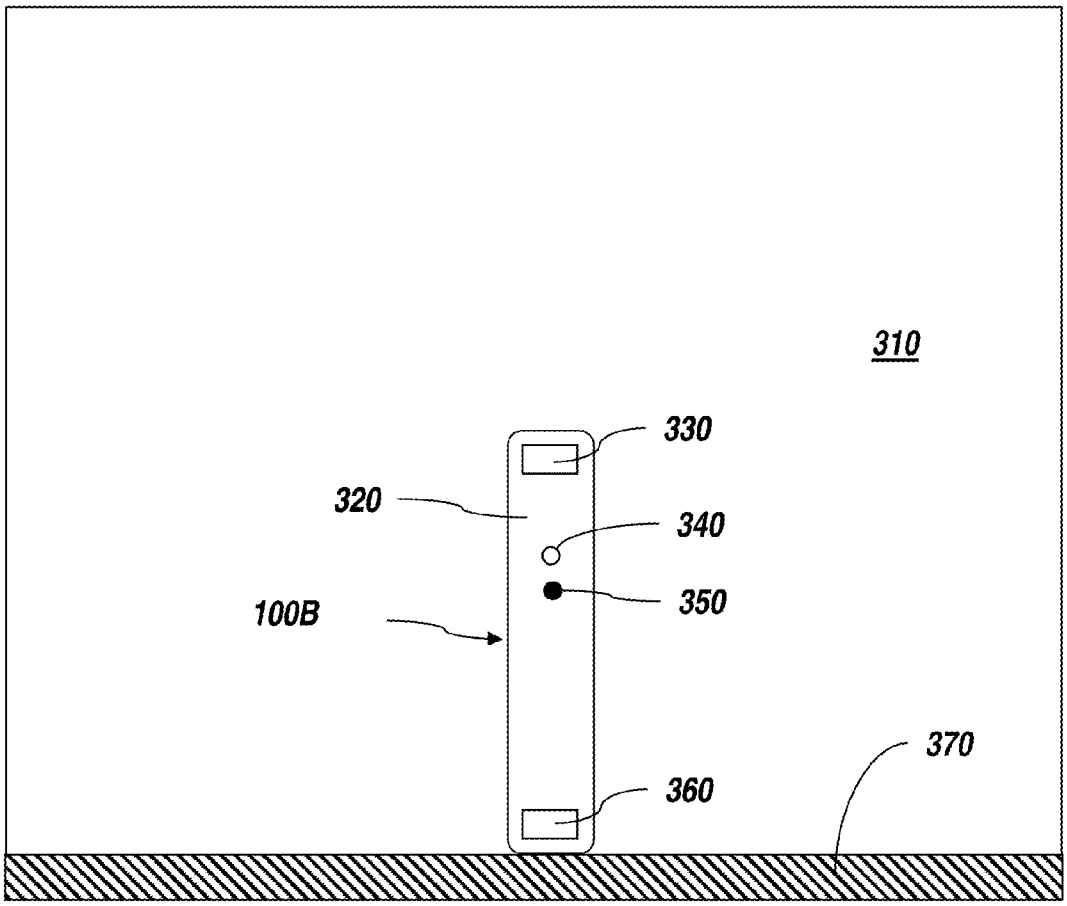
FIG. 3 is a front perspective view of the fall detection system of the present invention mounted to a wall within a room.
Figure 4A:
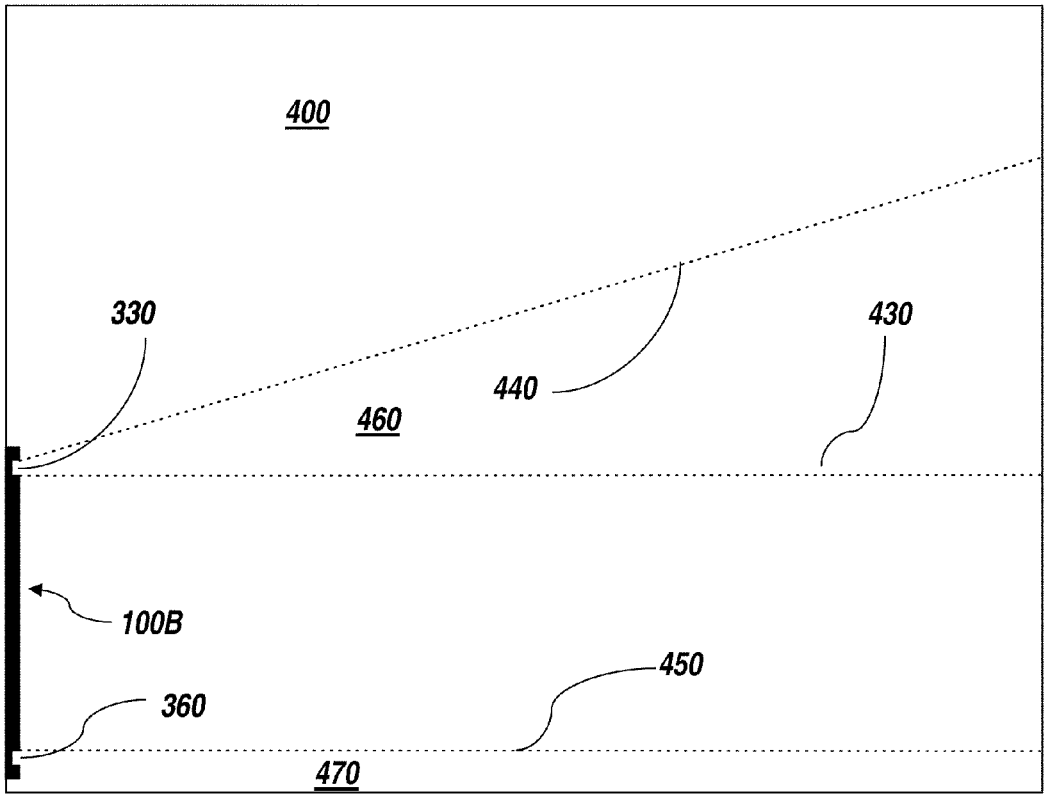
FIG. 4A is a side perspective view of the fall detection system of FIG. 3 illustrating how the system creates various detection zones within the room.

FIG. 3 illustrates a particular application of the fall detection system of the present invention. In the illustrated embodiment, the fall detection system 100B is mounted to a wall 310 of a room 400 (FIG. 4A). Similar to the embodiment described in FIG. 1, this embodiment has a top sensor assembly 330, a bottom sensor assembly 360, optional indicators and annunciators 340, and/or buttons 350. In the illustrated embodiment, the sensor assemblies 330 and 360 are housed within a suitable case 320, which can be composed of well known materials, such as plastic, metal, wood or other suitable materials. The fall detector system 100B is well suited for mounting directly to a wall 310 as might be appropriate in an institution such as a hospital or skilled nursing facility. In the illustrated configuration, the bottom of the fall detector system 100B can be mounted above the baseboard molding 370 of the wall 310 or alternatively can directly touch the floor.

Regardless of the specific installation of the fall detector system, the top and bottom sensor assemblies divide the room into two general areas. FIG. 4A is a general depiction of a side view of the room 400 with a fall detector system 100B mounted on a lower portion of the wall 310. The fall detector system 100B has a top sensor assembly 330 and a bottom sensor assembly 360, as described above. The sensor assemblies 330 and 360 establish at least two distinct detection zones in the room, i.e. the top or upper detection zone 460 and the bottom or lower detection zone 470. The bottom sensor assembly 360 is configured to create the bottom or lower detection zone 470 that extends from the floor of the room 400 to an upper level as indicated by the dashed-line 450. The upper level of the bottom detection zone 470 may be about the height of the bottom sensor assembly 360, i.e. the upper level of the bottom detection zone 470 may be slightly higher or slightly lower than the position of the bottom sensor assembly 360. Those of ordinary skill will readily recognize that the fall detection system can be mounted at any suitable location on the wall, and that the actual height of the detection zone 470 can vary provided it is sufficiently close to the floor of the room 400 for detection purposes. Similarly, the top sensor assembly 330 creates the top or upper detection zone 460 that extends upwardly from a lower level indicated by the dashed line 430 to an upper level of the top detection zone 460 indicated by the dashed line 440. The lower level of the top detection zone 460 is provided a predetermined height. Those of ordinary skill will readily recognize that the shape of the top detection zone 460 and the height of the upper level of the top detection zone 460 relative to the floor can vary provided it is mounted in such a way so as to detect a person or object within the top detection zone 460.

The sensor assemblies 330 and 360 sense or detect radiation, such as bodily heat radiation, or other energy in the upper detection zone 460 and the lower detection zone 470, respectively. For the sake of simplicity, we describe the components of the top sensor assembly 330. Those of ordinary skill will readily recognize that the bottom sensor assembly 360 can include the same or different components. According to a preferred embodiment, the sensor assembly employs a pyroelectric infrared (PIR) element, such as the RE200B from Nippon Ceramic Ltd of Hirooka, Japan. In addition to the PIR element, the sensor assembly can also include Fresnel lenses, such as supplied by Fresnel Technologies of Ft. Worth, Tex.

Figure 4B:
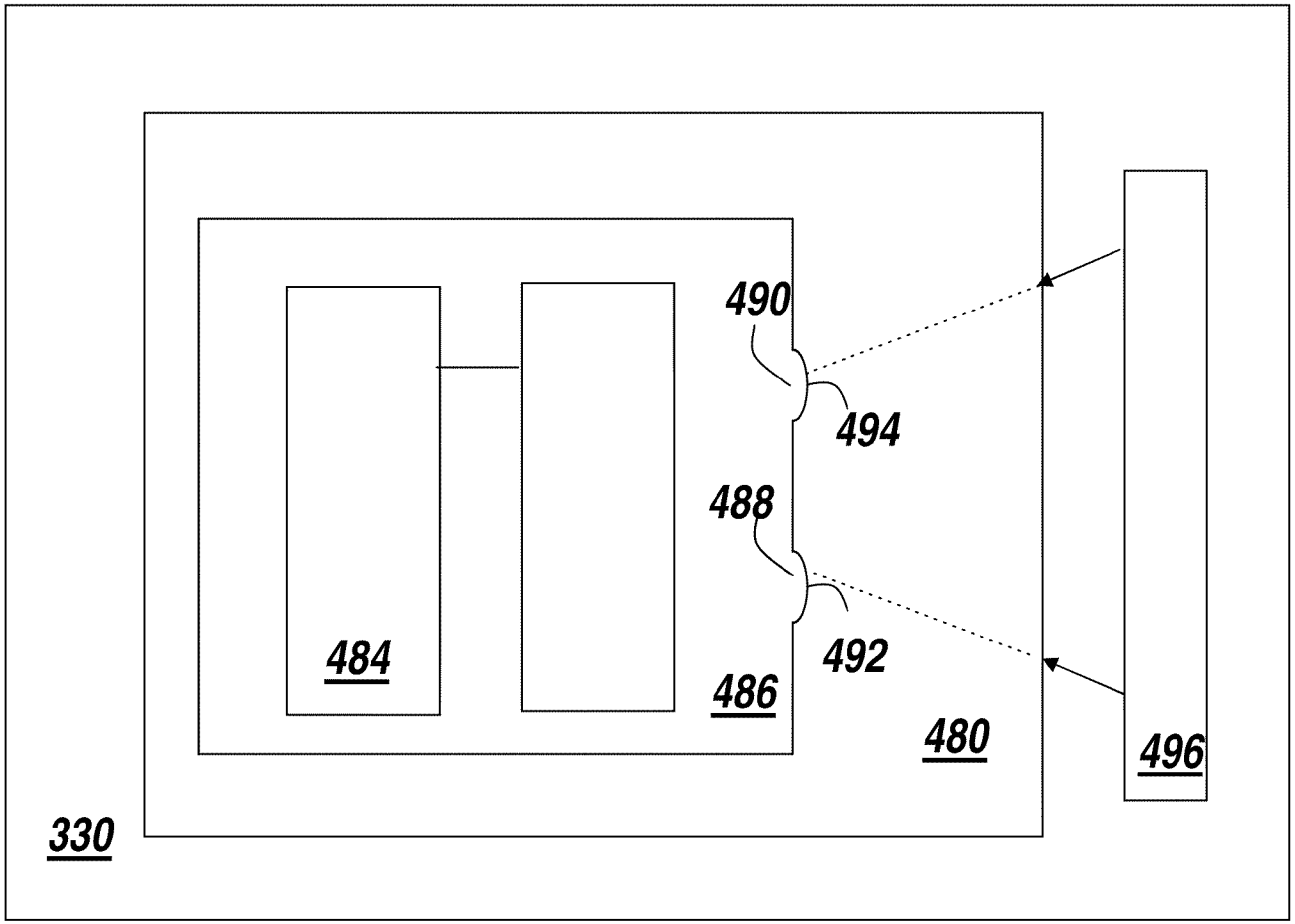
FIG. 4B depicts an exemplary pyroelectric infrared (PIR) element.

The PIR element is an electrical/optical assembly optimized to detect the radiation, such as infrared radiation, emitted from a person or object. The radiation emitted from a person has a wavelength typically between of about 8 and about 14 μm. An exemplary PIR element is illustrated in FIG. 4B. The PIR element 480 can include a sensing component 482 which consists of a lithium tantalite chip coated with an energy absorbing black coating. Connected to the tantalite chip are typically a high impedance resistor and a FET transistor which form an impedance transformer, represented by 484 in FIG. 4B. These parts are all packaged in a small metal case (i.e. a "TO-5" case) 486 that has two small windows 488 and 490, each with a covering 492 and 494 which allows the transmission of infrared (IR) energy therethrough.

Figure 7:
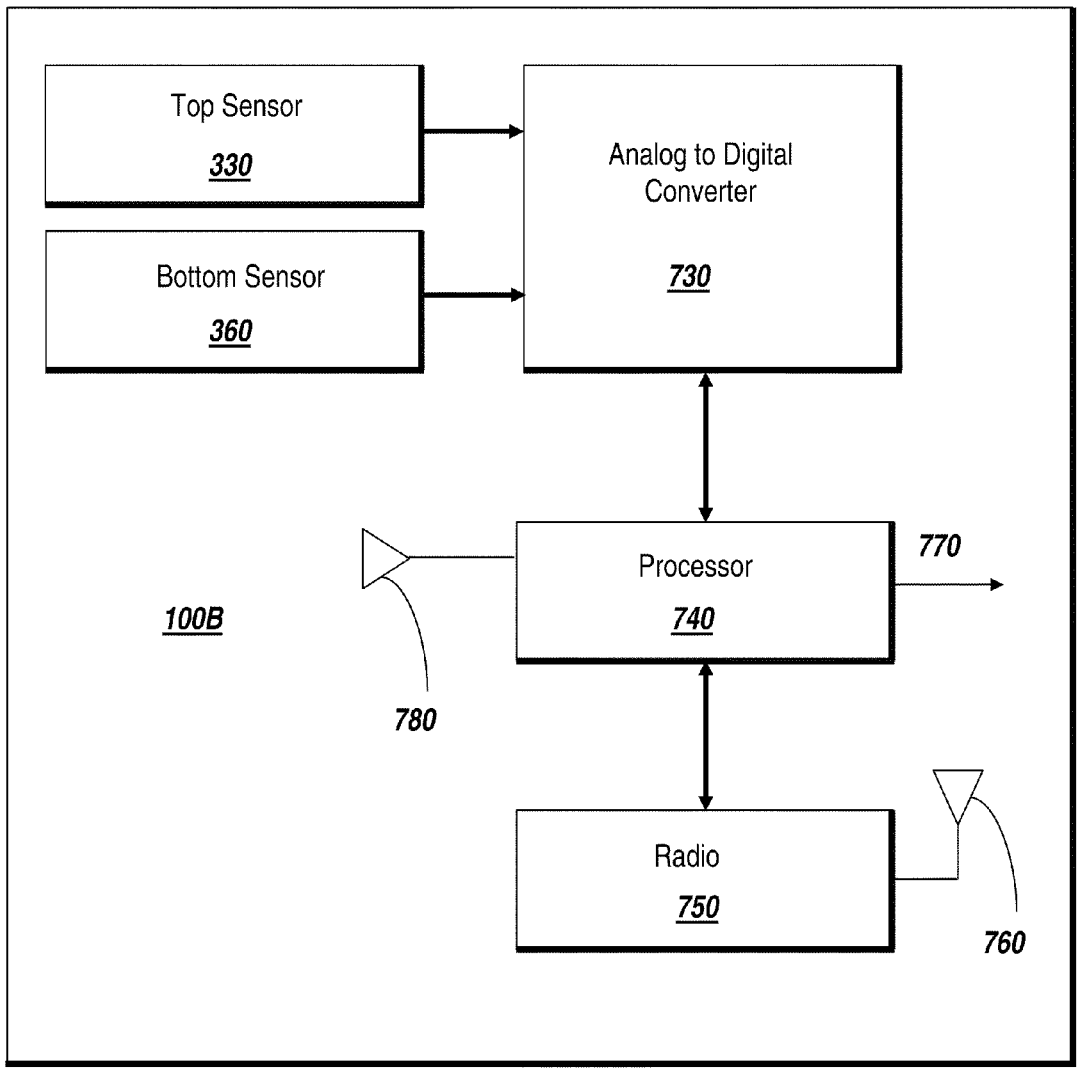
FIG. 7 is a schematic block diagram illustrating the components of the fall detection system of the invention.

In operation, the PIR element 480 is mounted on a printed circuit board and the output of the electronics 484 in the PIR element connects to the ADC (730 in FIG. 7). The external Fresnel lens 496 concentrates IR energy onto either or both windows 488 and 490 of the PIR element 480. Those of ordinary skill will readily recognize that the PIR element 480 can form the basis for a motion detector, which are commonly used in security systems to detect movement. When a person or object that radiates IR energy moves in front of a motion detector, the Fresnel lens 496 focuses the energy from the radiating body onto the windows 488 and 490 in the PIR element 480. The concentrated IR radiation or energy activates the PIR element 480, which in response creates a voltage output. If the IR radiating body moves, the focused energy also moves across the PIR windows 488 and 490 and creates a voltage output of opposite polarity to the first output. The transistor in the PIR element 480 detects this abrupt voltage change and is activated, therefore indicating motion. If there is no motion for several seconds, the output normalizes to a predetermined DC level, which is how the system adjusts to ambient temperature changes.

Figure 5:
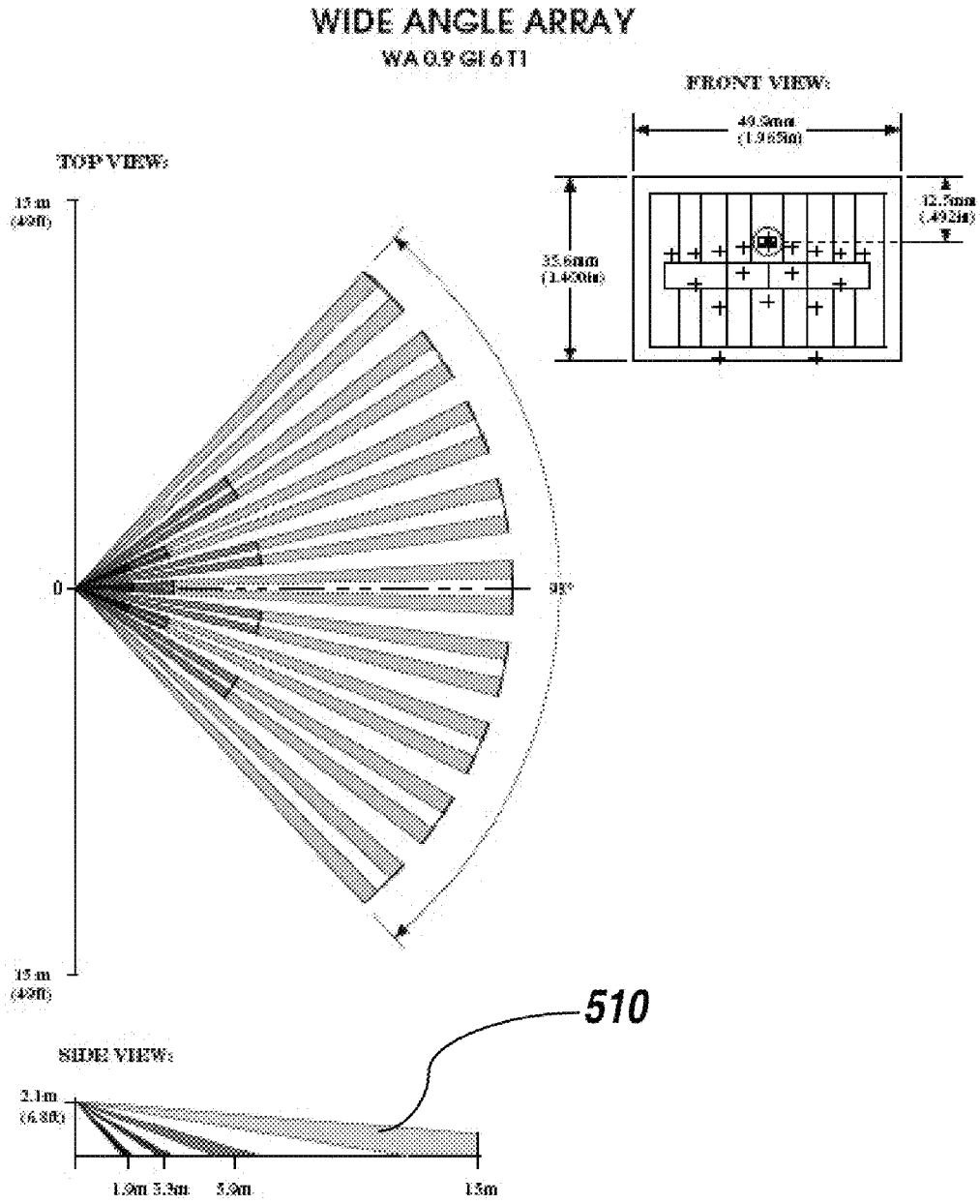
Fig. 5 (prior art)
FIG. 5 depicts a typical wide angle array reception pattern of a conventional motion detector.
Figure 6:
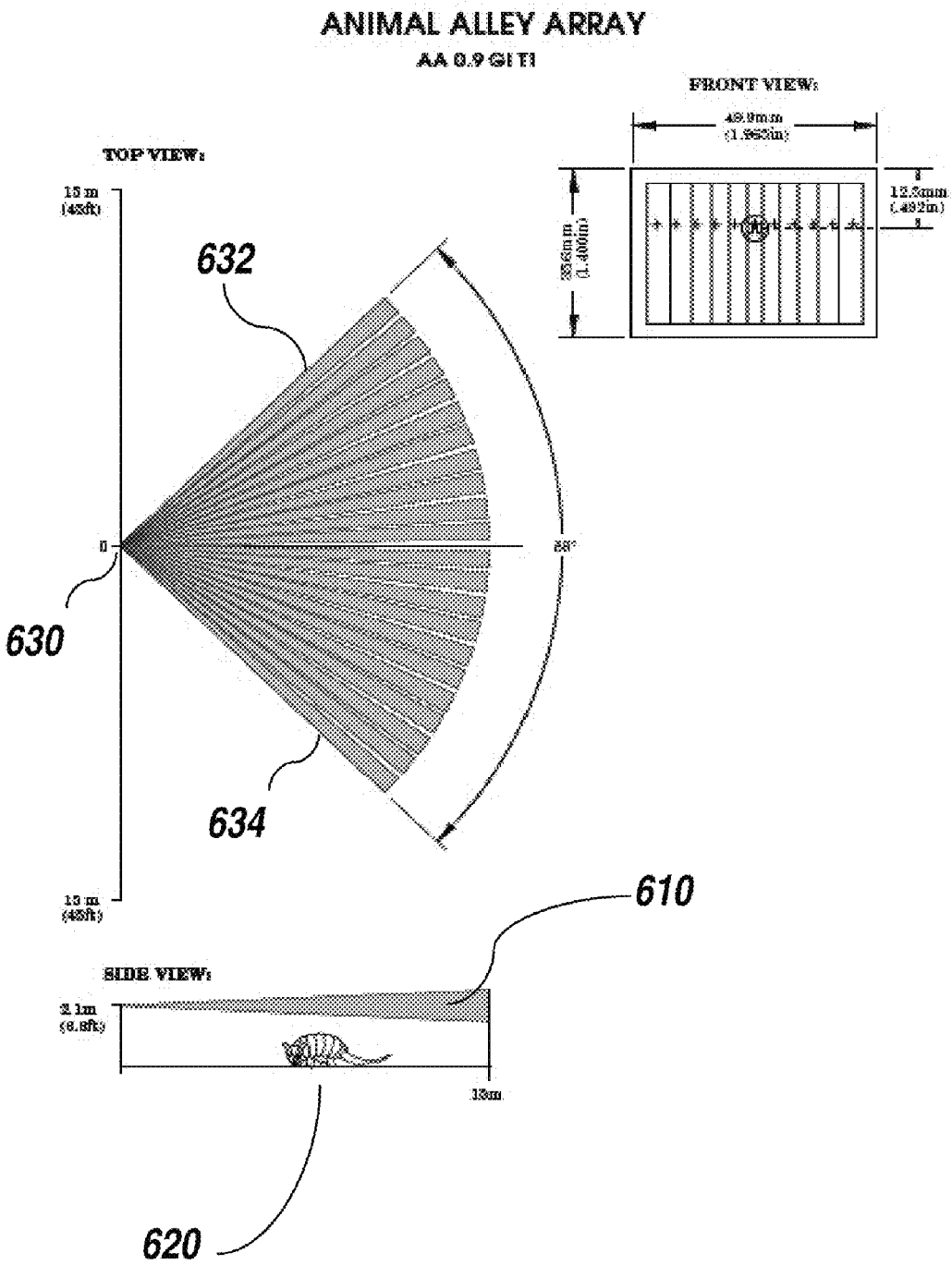
Fig. 6 (prior art)
FIG. 6 depicts a typical animal alley array reception pattern of a conventional motion detector with an animal-proof lens.

One having ordinary skill will readily recognize that motion detectors having multiple zones can be created by using a Fresnel lenses. For example, U.S. Pat. Nos. 5,670,943, 7,411,489 and U.S. Patent Application 2005/031353A1, the contents of which are incorporated by reference, describe pet immune motion sensors. FIG. 5 shows the reception pattern 510 for a Fresnel lens called a "Wide Angle Array" supplied by Fresnel Technologies (Ft. Worth, Tex.) which is used in a typical motion detector. FIG. 6 shows the reception pattern 610 for a Fresnel lens from the same company called the "Animal Alley Array." Comparing the side view of the reception pattern 510 in FIG. 5 to the side view of the reception pattern 610 of FIG. 6, it is clear that the reception pattern 510 reaches all the way to the ground with multiple beams, thus allowing the motion detector to be triggered by subjects crawling on the ground. On the other hand, the reception pattern 610 does not extend to the ground thus reducing the probability of the motion detector being triggered when an animal, such as the animal 620 in FIG. 6, moves across the detector. Also note that the reception pattern 610 is triangular shaped, with the narrowest area at the left, i.e. closer to the sensor 630, the widest area at the right, i.e. away from the sensor 630, and two lines 632 and 634 extending out from the sensor 630 which are not parallel to the ground.

In light of the above description, it will be apparent to one having ordinary skill that if a person is not moving, a conventional motion detector will not detect motion. Therefore, if a person falls down and is substantially still, e.g. unconscious, the motion detector gives no output after the initial fall. Also, since motion detectors are optimized for use in security systems, their Fresnel lens is optimized to detect people walking—the two windows of the PIR element are configured horizontally (parallel to the ground). In the case of a fall, most of the movement is vertical, i.e. from an elevation toward the ground. Hence, according to the present invention, the Fresnel lens and the PIR windows of the sensor assembly are optimized to detect vertical motion (i.e., perpendicular to the ground).

Referring again to FIGS. 4A-4B, top sensor assembly 330 includes a PIR element 480 and a Fresnel lens 496. The top sensor assembly 330 is optimized to detect vertical motion. This is accomplished by mounting the PIR element 480 such that the two windows 488 and 490 are vertically aligned, such that one window 490 is on top of the other 488. Each PIR element 480 is also mounted on the printed circuit board at an angle or has part of its windows masked to create the unique reception patterns 460 and 470. More specifically, unlike conventional "pet immune" motion detectors such as those illustrated FIG. 6, the sensor assembly 330 is configured in such a way so as to create a coverage area 460 that has one side 430 which is approximately parallel to the floor. Similarly, the bottom sensor assembly 360 creates a coverage area 470 with one side 450 that is also substantially parallel to the ground. Additionally, the sensor assembly 330 has a cylindrical Fresnel lens 496, such as one supplied by Fresnel Technologies (Ft. Worth, Tex.), which along with the mounting position of the PIR elements 330 described above, creates top detection zone 460 and the bottom detection zone 470. While two detection zones are indicated in FIG. 4A, additional sensor assemblies can be employed in an alternative embodiment so as to create additional detection zones. The additional detection zones increases the sensitivity of the system. Alternatively or additionally, additional sensors can be added to the system. Some of these can create additional zones. In addition, some of these may also be optimized in a way similar to a more traditional security system motion detector to detect a "horizontal" motion (i.e. walking). These additional sensors can be used to further reduce false alarms. For example, sensors 330 and 360 may be accelerometers which can detect vibrations of the floor or other solid surface. Accelerometers may be used in addition to PIR sensors. Other sensors that may be used include visible or infrared cameras, thermal sensors, ultrawideband or radar transceiving sensors, magnetic sensors, acoustic sensors (microphones), ultrasound sensors, ultra-wide band (UWB) sensors or other appropriate devices.

FIG. 7 is a schematic block diagram illustrating further details of the fall detection system 100B. The top and bottom sensor assemblies 330 and 360 (which are the same as the assemblies 120 and 170 of system 100A in FIG. 1) provide a voltage output proportional to the energy received by the PIR element. This output is not the binary output of a motion detector (i.e. "on" if there is motion detected or "off" if no motion is detected) but rather an analog voltage proportional to the energy received. This voltage is processed by an analog-to-digital converter (ADC) 730 and the digitized value proportional to the energy received is transmitted to a processor 740. In one embodiment, the ADC 730 samples at a particular rate, e.g. 5 samples-per-second and 12 bits of resolution. Those skilled in the art will recognize that the sample rate and resolution, and whether the ADC 730 is separate or integrated with the processor 740, as well as other details of this sampling, can be accomplished with a variety of approaches. Not shown in FIG. 7 but also well understood by those skilled in the art are the various periphery systems of the assembly such as the battery, memory, power supply, display, buttons, indicators, etc. FIG. 7 also includes an annunciator 780. Upon detection of a fall, the processor 740 sends a signal to the transmitting device (e.g., radio) 750 which can be connected to an antenna 760 for broadcasting purposes.

Figure 9:
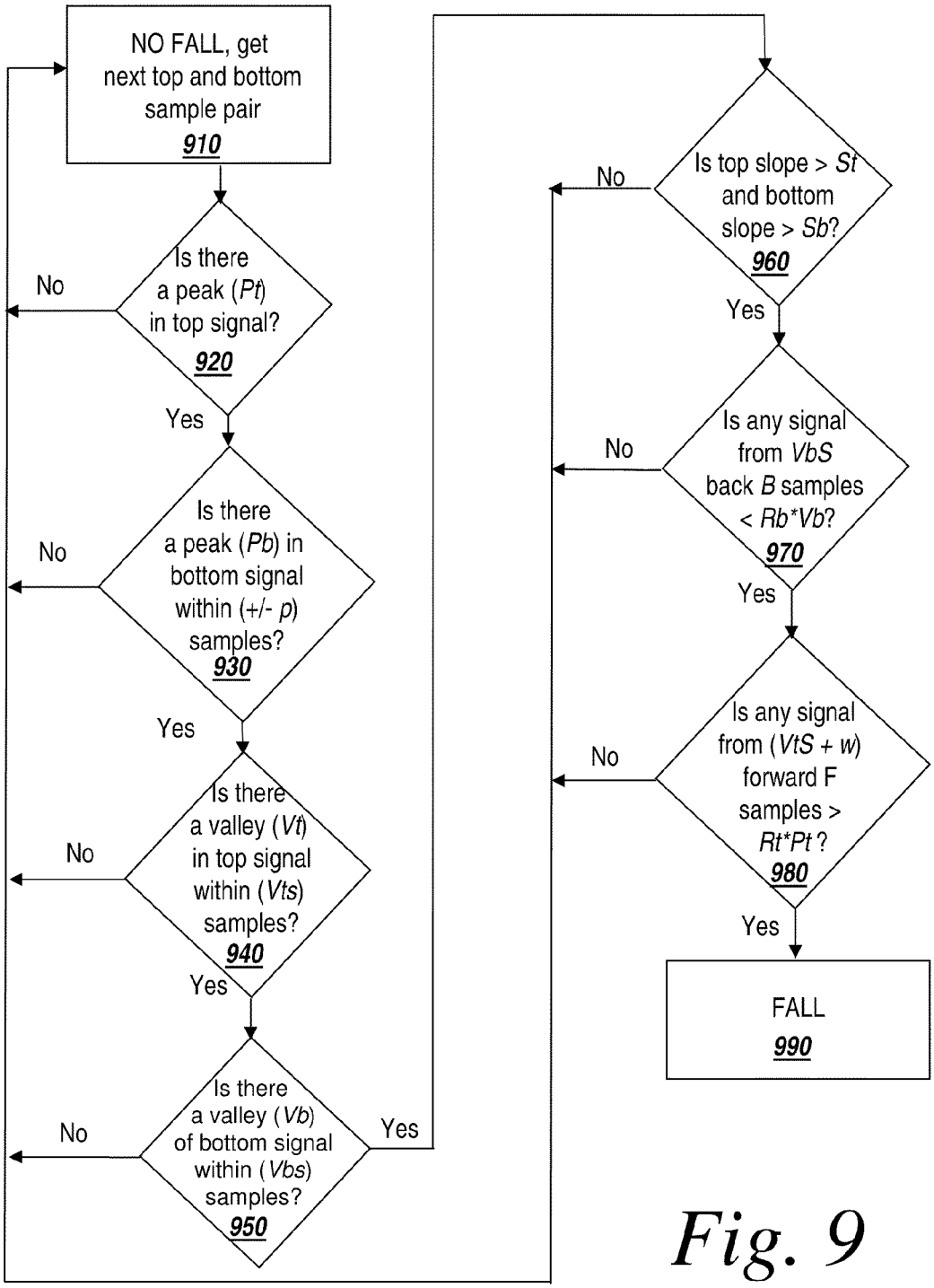
FIG. 9 is a schematic flow chart depiction illustrating the signal processing of the sensed signal outputs.

The processor 740 of FIG. 7 may contain pattern recognition logic 790. Pattern recognition logic 790 processes the inputs from ADC 730 and determines if certain patterns exist, such as a pattern that may indicate a fall or activity. FIG. 9 shows one representative pattern matching process performed by the pattern recognition logic 790.

The radio 750 transmits a message indicating a fall to other devices such as those described above in relation to FIG. 2. In addition or alternatively to the radio transmission, the processor 740 may also send a signal through a wired connection 770. This signal can be a message such as an Ethernet packet or it can be a simple binary "switch closure" such as would be required by a nurse-call system.

Figure 8:
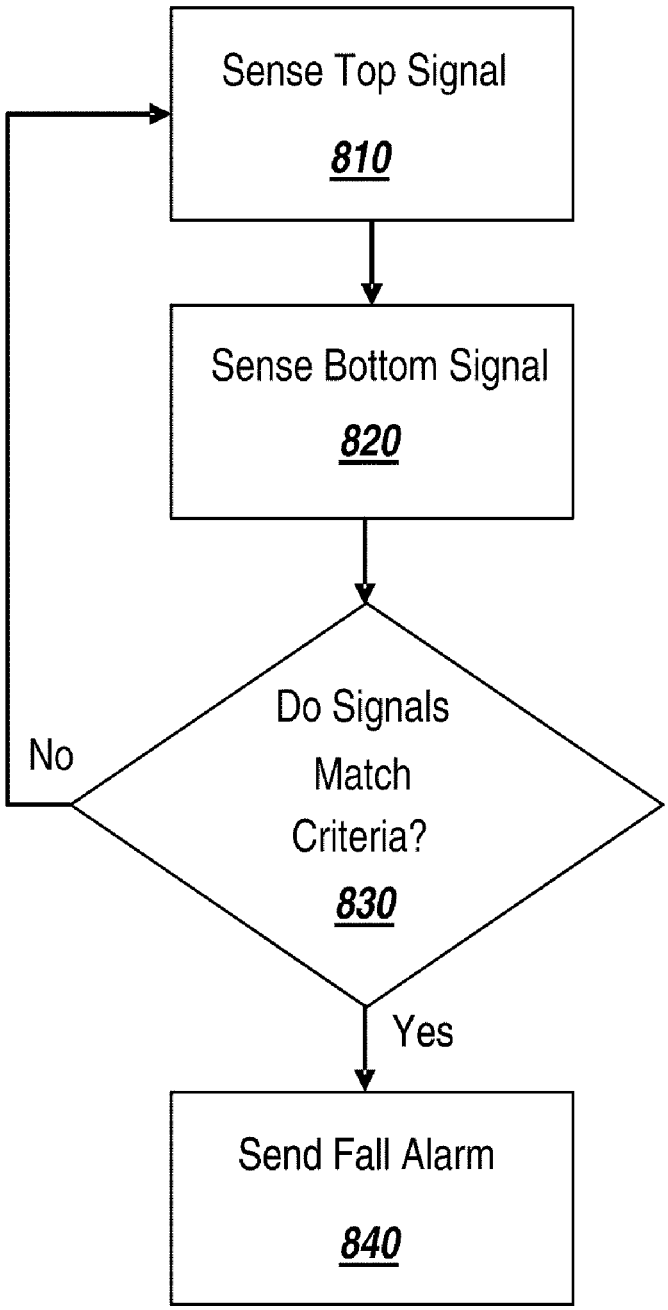
FIG. 8 is a schematic flow chart depiction illustrating the operation of the fall detection system of the invention.

FIG. 8 depicts a high-level flowchart of how the detector assembly detects a fall. The processor receives the digitized voltage from the top sensor (step 810). The processor subsequently receives the digitized voltage from the bottom sensor (step 820). The processor then analyzes the received digitized voltages to determine if they match a specified predetermined criteria (step 830). This criteria can be varied depending on the circumstances. For example, since the primary focus of the present invention is to detect falls, the aforementioned criteria would be those representing a fall. If the received digitized voltages match the specified predetermined criteria, a message (such as a fall alarm) is sent (step 840). However, other criteria may also be analyzed, such as if the received digitized voltages are representative of activity. If the received digitized voltages match the "activity criteria", a message can be sent indicating activity.

Figure 10:
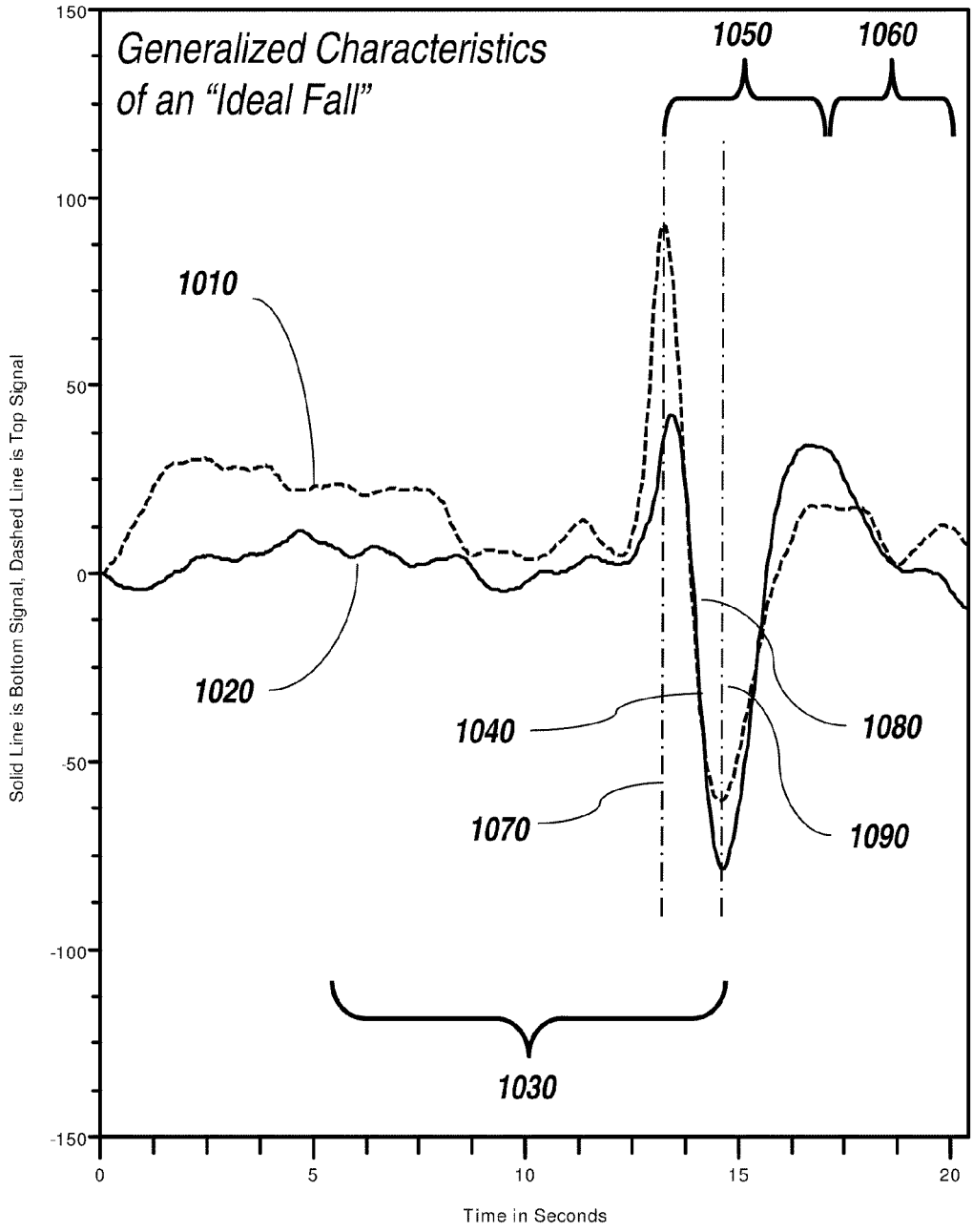
FIG. 10 depicts representative signal outputs of the sensor assemblies of the fall detection system of the invention during a fall.

More specific details of how the signals are analyzed by the pattern recognition logic 790 executed in processor 740 are depicted in FIG. 9. FIG. 9 illustrates tests that are performed during a pattern recognition process. The processor is programmed to perform the tests illustrated in FIG. 9. The analysis steps in FIG. 9 will be more easily understood by also referring to FIG. 10. FIG. 10 is a representation of the voltage outputs of the top and bottom sensors during a typical "perfect" fall, i.e. when a person falls on the ground. The top voltage output 1010 is shown with a dashed line and the bottom voltage output 1020 is shown with a solid line. Both of these are illustrated in terms of ADC counts (an arbitrary unit proportional to voltage) on the vertical axis versus time on the horizontal axis. Note the large positive spike in the top signal, indicated by the dot-dash line labeled 1070 in FIG. 10 indicates the point of a fall. The second spike, negative in amplitude, in both the top and bottom signals labeled by a dot-dash line labeled 1090 in FIG. 10 illustrates a "recovery signal" which characterizes falls.

Referring again to FIG. 9, the process starts with assuming that there has been no previously detected fall, the processor receives or retrieves a new pair of signal samples from the top and bottom sensor assemblies (step 910). In general throughout the analysis depicted in FIG. 9 a test is conducted and if the results are false, indicating that the analyzed signals do not match the specific test criteria representative of a fall, the processing goes back to step 910. If a particular test does pass (i.e. results in a positive output), the processor moves on to the next test. If all the tests result in positive outputs, the processor indicates that a fall has occurred.

Referring again to FIG. 9, the first test in the analysis is to determine if there is a positive peak in the top signal, such as one analogous to point 1070 in FIG. 10, (step 920). For the sake of illustration this peak will be designated Pt and occurs at point PtS. If there is no peak, the test aborts and the routine returns to the beginning, i.e. step 910. The processor receives or retrieves another set of signal samples from the top and bottom sensor assemblies. If there is a positive peak at step 920, the process continues to the next test determining if there is a positive peak in the bottom signal (step 930). This peak is designated Pb and occurs at PbS. The peak is within the absolute value of a certain number of samples, designated p. These peaks, i.e. PtS and PbS, are representative of the physical realities of a fall. A falling human creates a large amount of IR energy which passes through the top zone (460 in FIG. 4A) and into the bottom zone (470 in FIG. 4A), thus generates large signal outputs at both the top and bottom sensors.

The process then performs the next test to determine if there is a large negative peak (hereafter referred to as a "valley") in the top signal (step 940). The large negative peak is designated Vt, occurring at VtS, within some number of samples (Vts) of the top peak Pt. If Vt is detected, the system moves on to the next test which determines if there is an analogous large negative peak in the bottom signal (step 950). The large negative peak is designated Vb, occurring at VbS, within Vbs samples of the bottom peak Pb. If these valleys, i.e. Vt and Vb, do not occur within the required period of time, the analysis routine goes back to step 910.

If the valley points, i.e. Vt and Vb, are detected, the system continues to the next test that determines if the slopes of lines between the peaks and valleys are large enough (step 960). In other words, the slope 1040 between points PtS and VtS for the top signal and the slope 1080 between points PbS and VbS for the bottom signal must both be large enough, i.e. larger than a predetermined amount. If the slope 1040 of the top sensor signal is greater than St, and the slope 1080 of the bottom sensor signal is greater than Sb, the system moves on to the next test, i.e. the output of step 960 is "yes". Step 960 essentially requires that the fall signal is representative of a body physically moving down toward the ground very quickly. A body that moves from one zone to another zone too slowly (such as when a person lowers themselves into a chair or onto the floor in a controlled way) will generate a smaller slope and hence fail the test performed at step 960.

Referring again to FIG. 9, the next test analyzes backward from the point of the bottom signal valley VbS (point 1090 in FIG. 10) for B samples. The test determines if any signal in that interval is more negative than the amplitude of the bottom signal valley signal Vb times some scaling constant Rb (step 970). In FIG. 10 this "look back" period is designated as 1030. The purpose of this test is to eliminate false positive alarms generated by pets. If there are pets moving in the bottom zone, there will be a large number of high-amplitude signals in the bottom signal. This notion is discussed in detailed with respect to FIG. 11.

The next test in the process illustrated in FIG. 9 waits some period of time w (designated 1050 in FIG. 10) after the point of the top signal peak VtS (point 1070 in FIG. 10). The test then begins to look for signals that are more positive than the amplitude of the top signal peak Pt times some scaling constant Rt within some number of samples F (step 980). In FIG. 10 this "look forward" period F is designated as 1060. The purpose of this test is to see if there is motion in the top zone after the time of the possible fall; if there is motion this likely indicates that a human is moving in the top zone. Either the fall victim has gotten up from the floor or someone has entered the room to help them. In either case, an alarm need not be generated. Note that since the actual fall occurred at the peak signal output VtS and there is subsequent analysis for (w+F) samples, the fall alarm can not be generated until the time VtS+F+w. The longer the wait period w and the sample period F, the longer the time required generating the alarm on a fall.

If all of the tests illustrated in steps 920 through 980 have passed, i.e. have a positive output, the processor determines that the signals are characteristic of a fall and generates a fall alarm (step 990).

The various parameters which define the characteristics of a fall (p, Vts, Vbs, St, Sb, B, F, w, Rb, and Rt) are based on the unique circumstances of the environment. For example, if the system is to be installed in an environment where there are no pets, B may be very short or Rb may be very small. Alternatively, if there are pets in the environment B may be made longer or Rb greater. Similarly, if there is only one person at the monitored home F may be set to a very short time. These parameters can be stored or modified by the processor or by an external control mechanism or intervention upon manufacture, installation or in "real time". Modifications made in "real time" can be based on the collected sensor data.

As described above, the various parameters that define the pattern matching in FIG. 9 can be preloaded into the processor or its memory or can be calculated in real-time. In one embodiment, the parameters may be:

p=20 samples (approximately 4 seconds)

Vts=30 samples (approximately 6 seconds)

Vbs=30 samples (approximately 6 seconds)

St=100 counts-per-samples

Sb=100 counts-per-samples

B=100 samples (approximately 20 seconds)

F=100 samples (approximately 20 seconds)

Rb=90%

Rt=85%

Figure 11:
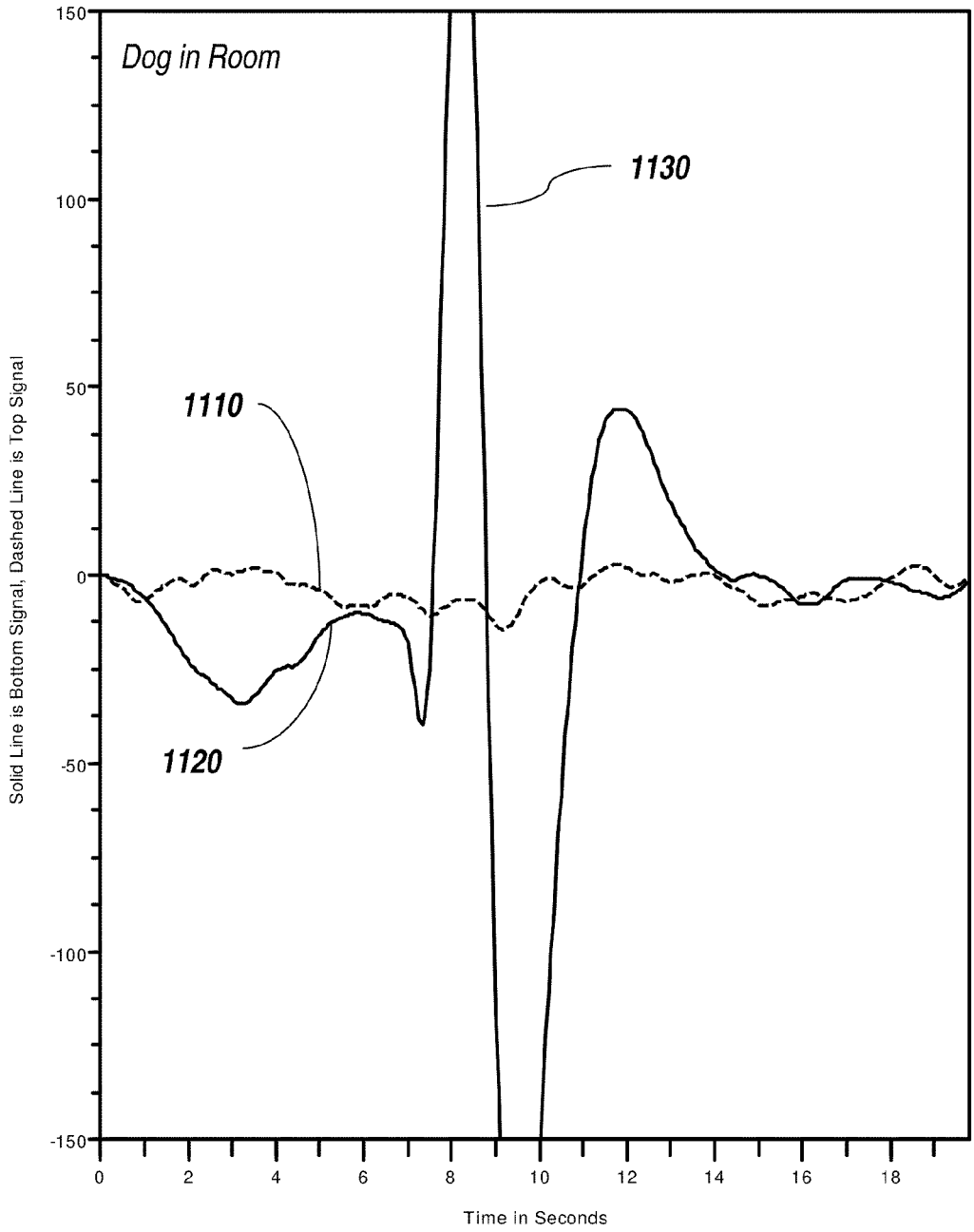
FIG. 11 depicts representative signal outputs of the sensor assemblies of the fall detection system of the invention when an animal is in the room.
Figure 12:
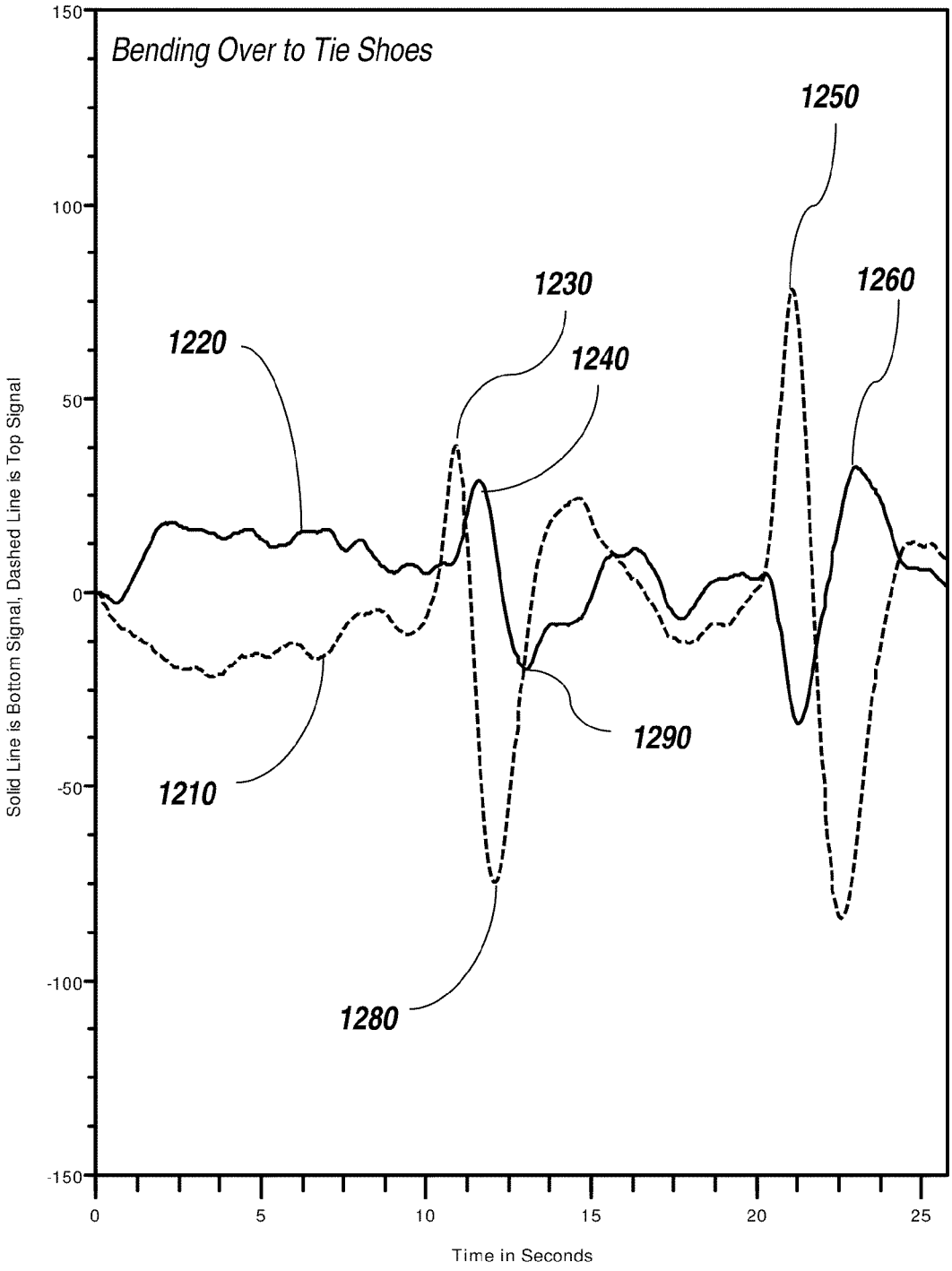
FIG. 12 depicts representative signal outputs of the sensor assemblies of the fall detection system of the invention when a person bends over.
Figure 13:
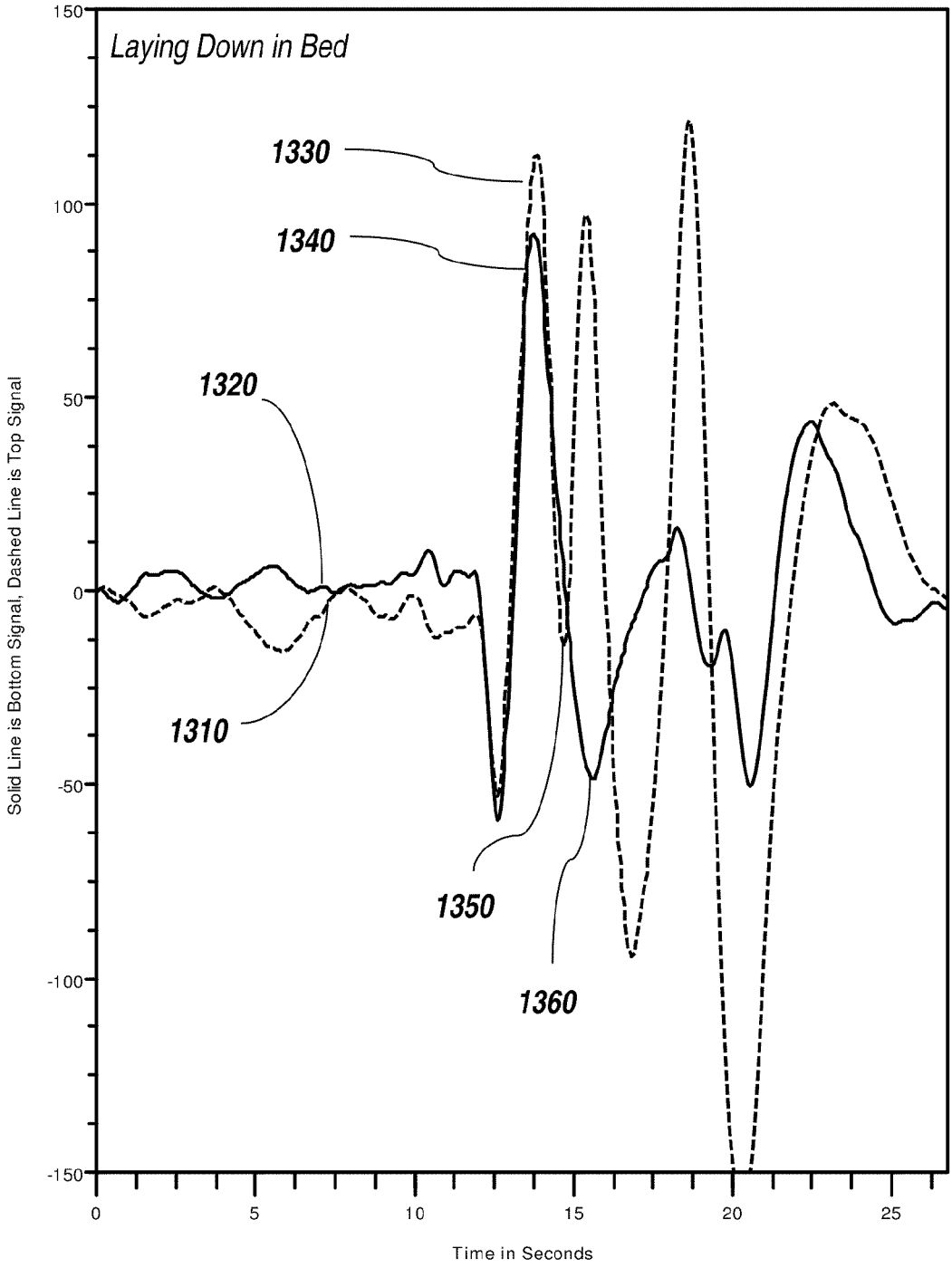
FIG. 13 depicts representative signal outputs of the sensor assemblies of the fall detection system of the invention when a person lays down.
Figure 14:
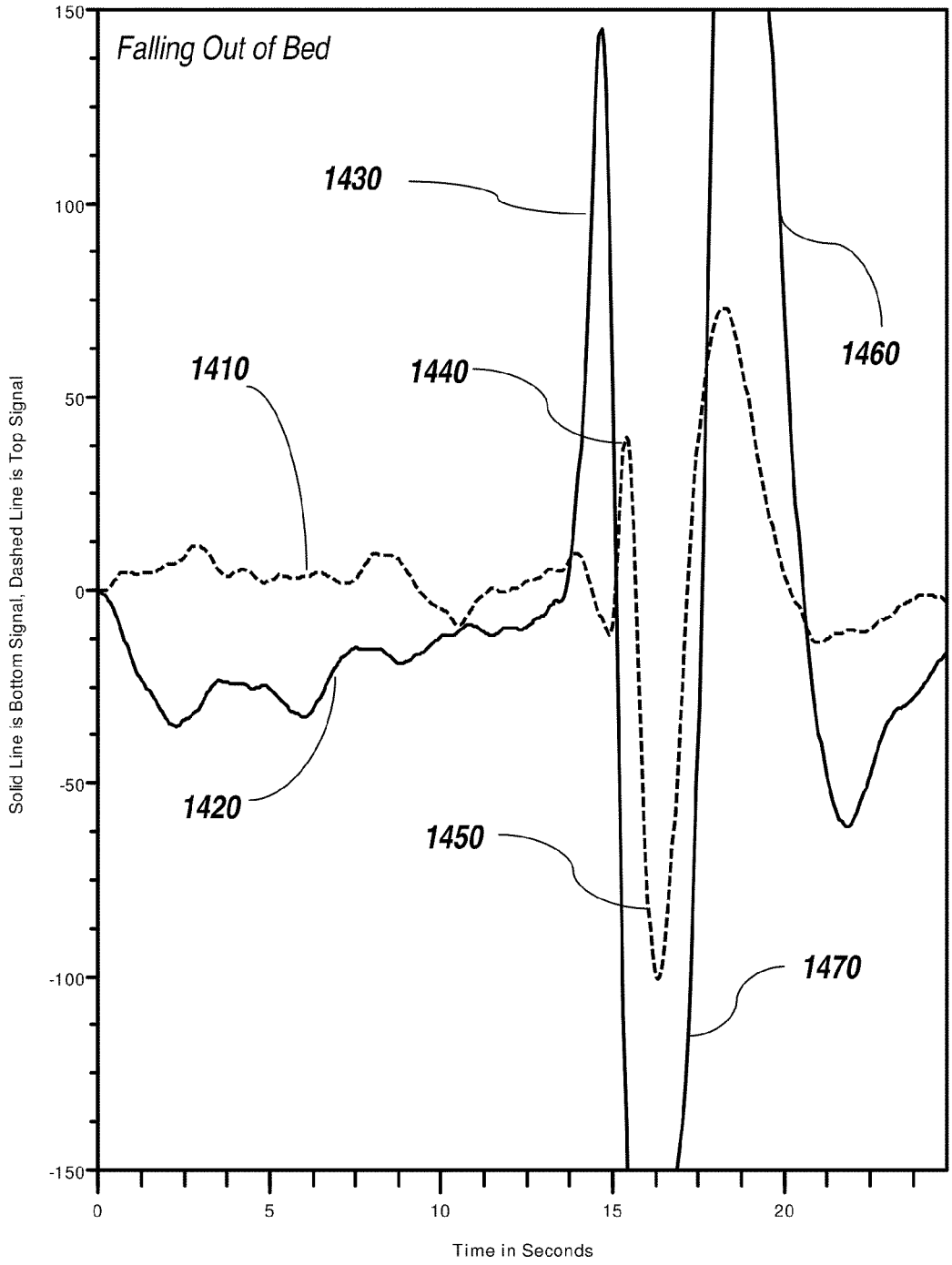
FIG. 14 depicts representative signal outputs of the sensor assemblies of the fall detection system of the invention when a person falls out of bed.
Figure 15:
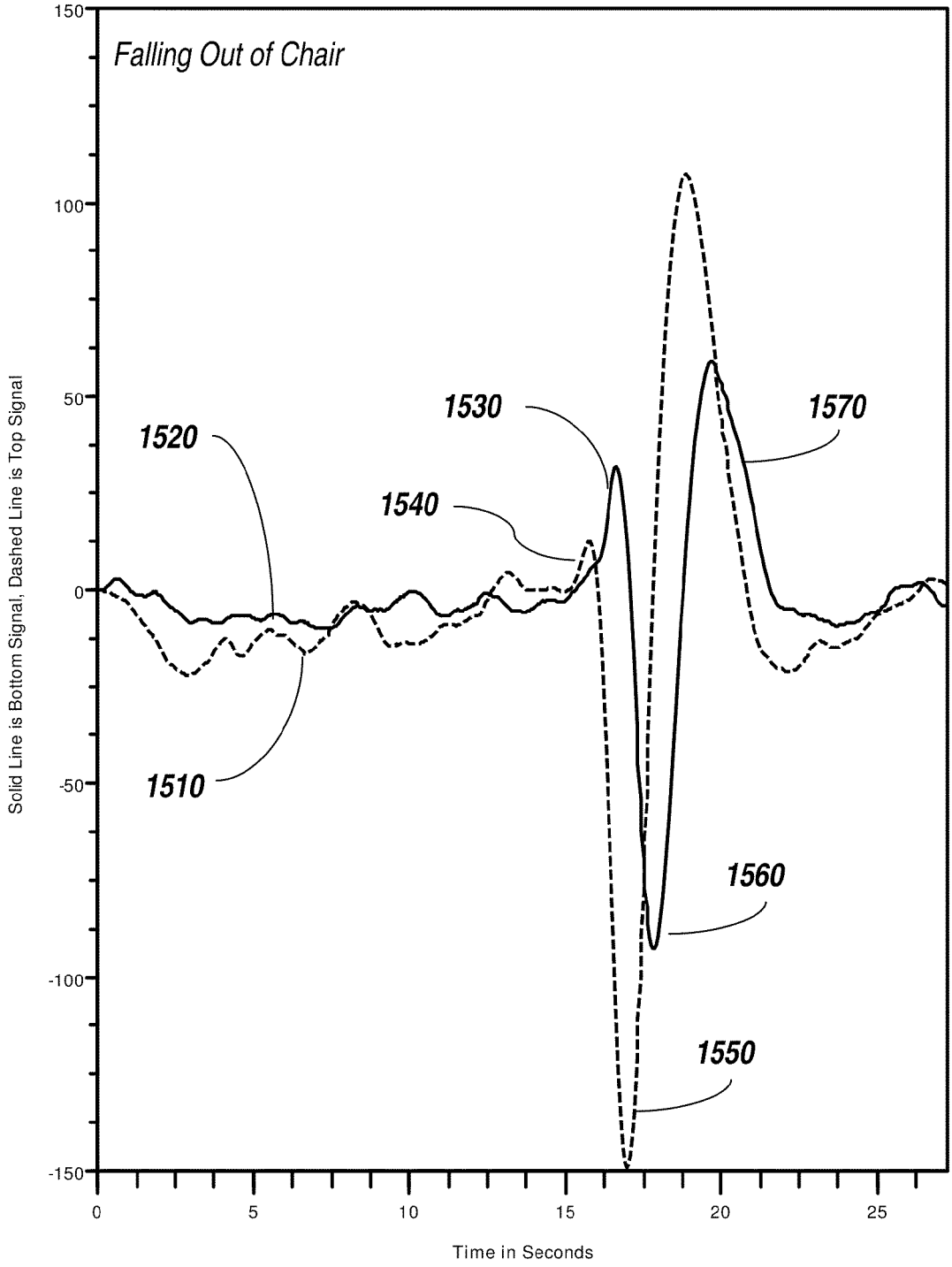
FIG. 15 depicts representative signal outputs of the sensor assemblies of the fall detection system of the invention when a person falls out of a chair.

FIGS. 11 through 15 are similar to FIG. 10 in that they depict different common scenarios that may be encountered in a monitored location. These will be used to demonstrate how the analysis routine depicted in FIG. 9 can differentiate true from false falls. FIGS. 11, 12 and 13 illustrate scenarios when no alarm should occur. FIGS. 14 and 15 illustrate scenarios when a fall alarm should be generated.

FIG. 11 depicts representative signal outputs of the sensors when a dog or other animal is in the room. The top signal is illustrated with the dashed line 1110 and the bottom signal is illustrated with the solid line 1120. While there is a large spike 1130 in the bottom signal, there is no analogous large spike in the top signal. Therefore, this would fail the test illustrated in step 920 of FIG. 9. Thus, this situation would not be designated as a fall. The large spike 1130 in the bottom signal is generated from a dog moving in the bottom zone (470 in FIG. 4A). Since the dog's body never enters the top zone (460 in FIG. 4A), there is no significant signal generated by the top sensor and its output 1110 remains small compared to the bottom sensor output.

FIG. 11 also shows how the system can be used as a reliable indicator of human activity. The general principle is that if there is little variation in the top signal over time, there is likely no human walking or otherwise active in the protected area. Specifically, if the top signal 1110 in FIG. 11 is averaged over some period of time, the result would indicate that the signal is essentially random noise and this would indicate that there is no human activity in the area. In contrast, in FIG. 12, a similar average of signal 1210 would result in a larger value which would indicate that there is likely human activity in the area.

FIG. 12 depicts representative signal outputs of the sensors when a person bends over toward the floor, for example, to tie their shoes. Similar to FIG. 11, the top signal is illustrated with the dashed line 1210 and the bottom signal is illustrated with the solid line 1220. There are two large positive peaks shown in FIG. 12, one at data point 1230 and one at point 1250. The first data point 1230 would pass the test illustrated in step 920 of FIG. 9. The next peak 1240 in the bottom signal 1220 is close enough in time so that it will pass the test illustrated in step 930 of FIG. 9. In other words, the time between data points 1240 and 1230 is less than the predetermined amount p. The data point 1280, i.e. the valley of the top signal, is close enough to allow the test illustrated in step 940 to pass. However the data point 1290, i.e. the valley of the bottom signal, is not close enough to peak 1240 so the test illustrated in step 950 will fail. The slope of the top signal (between points 1230 and 1280) is large enough, but the slope of the bottom signal (between points 1240 and 1290) is not. Thus, the test illustrated in step 960 will also fail. Looking now at peak 1250, again the test illustrated in step 920 would pass but the test illustrated in step 930 would fail because the next bottom peak 1260 is not close enough. In this figure, the signals are generated when the person bends over to tie their shoes. The peak 1230 is when the first shoe is tied and the peak 1250 is when the second shoe is tied. However, these downward motions are controlled and relatively slow with respect to an uncontrolled fall, so the time difference of the top and bottom peaks is large and the slopes between the peaks and valleys are small.

FIG. 13 depicts representative signal outputs of the sensors when a person lays down, for example, in bed. The top signal is illustrated with the dashed line 1310 and the bottom signal is illustrated with the solid line 1320. The top peak 1330 and the bottom peak 1340 occur very close in time, so tests illustrated in steps 920 and 930 of FIG. 9 will pass. There are corresponding negative valleys 1350 and 1360 so tests illustrated in steps 940 and 950 of FIG. 9 will also likely pass. However, the slope of the bottom signal (between points 1340 and 1360) is too small so test illustrated in step 960 will fail. As with FIG. 12, this is because it is instinctual for humans to not let themselves fall in an uncontrolled way, so this controlled "lowering" into the bed from a sitting position creates a signal slope out of the top sensor that is not very steep. Once again, the system will not generate an alarm in this scenario.

FIG. 14 depicts representative signal outputs of the sensors when a person falls out of bed. In this case, the system should generate an alarm. The top signal is illustrated with the dashed line 1410 and the bottom signal is illustrated with the solid line 1420. The positive top peak 1440 and bottom peak 1430 are close enough in time so tests illustrated in steps 920 and 930 will pass. There are analogous top and bottom valleys at points 1450 and 1470 so tests illustrated in steps 940 and 950 will pass also. The slope between points 1440 and 1450 is large, as is the slope between points 1430 and 1470, so test illustrated in step 960 passes. From point 1450 looking back in time, there are no large bottom signal valleys in the bottom signal so test illustrated in step 970 passes. Because point 1460 falls within the wait period w after point 1430, there is no large positive top peak after point 1430 and test illustrated in step 980 passes as well. Therefore, this scenario would be classified as a fall and an alarm would be generated.

FIG. 15 depicts representative signal outputs of the sensors when a person falls out of a chair. The top signal is illustrated with the dashed line 1510 and the bottom signal is illustrated with the solid line 1520. In the first 15 seconds there is little activity—the person is just sitting in the chair and not moving much. Then they begin to fall forward out of the chair and peaks 1530 and 1540 are generated. These are close in time so tests illustrated in steps 920 and 930 will pass. Analogous valleys 1560 and 1550 are then generated and tests illustrated in steps 940, 950 and 960 will also pass. There is essentially no bottom sensor motion before point 1560 so test illustrated in step 970 passes. Point 1570 is within the wait period w and there is no subsequent significant top sensor activity, so test 980 also passes. Therefore, this scenario is correctly identified as a fall and an alarm is generated.

Thus, the system and methodologies of the present invention provide an effective means for automatically detecting if a person has fallen down. A detector assembly senses energy from at least two sensors in at least two zones and analyzes that energy to determine if it is representative of a fall. The described automatic fall detection system is low cost and easily deployed. It does not require the fall victim to push any buttons, wear any sensors or change their normal activities in any way, yet it is highly immune to false alarms.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved.

The invention claimed is:

1. A method for detecting a fall, the method including:

receiving, using a processor, a first data associated with an output from a first sensor;

receiving, using the processor, a second data associated with an output from a second sensor;

analyzing, using the processor, the first data and the second data;

comparing, using the processor, a pattern formed by the first data and the second data to a predetermined pattern; and outputting, using the processor, an output associated with the predetermined pattern.

2. The method of claim 1, wherein the predetermined pattern is a pattern matching to a human fall.

3. The method of claim 1, wherein the predetermined pattern is a pattern matching to a human activity.

4. The method of claim 1, wherein the output associated with the predetermined pattern is a radio signal.

5. The method of claim 1, wherein the pattern formed by the first data and the second data includes one or more of valleys, peaks and high slopes.

6. The method of claim 5, wherein the predetermined pattern includes one or more of valleys, peaks and high slopes.

7. The method of claim 6, wherein comparing further comprises comparing the one or more of valleys, peaks and high slopes of the pattern formed by the first data and the second data to the one or more of valleys, peaks and high slopes of the predetermined pattern.

8. The method of claim 1, wherein analyzing comprises looking back in time for activity.

9. The method of claim 1, wherein analyzing comprises looking forward in time for activity.

10. The method of claim 1, wherein the output of the processor is wired or wireless.

11. A method for detecting human activity, the method comprising:

providing, using a first sensor, a first detection zone;

providing, using a second sensor, a second detection zone;

obtaining, using a processor, data associated with the first detection zone and the second detection zone;

comparing, using a pattern recognition logic stored on the processor, data associated with the first detection zone and the second detection zone to data associated with a predetermined pattern;

detecting, using the pattern recognition logic, a match between the data associated with the first detection zone and the second detection zone and the data associated with the predetermined pattern; and outputting, using the processor, a signal indicative of the match.

* * * * *